United States Patent [19]

Krell

[11] Patent Number: 4,600,199

[45] Date of Patent: Jul. 15, 1986

[54] THREE DIMENSIONAL PUZZLE

[76] Inventor: Udo Krell, Klovensteenweg 121, 2000 Hamburg 56, Fed. Rep. of Germany

[21] Appl. No.: 425,402

[22] Filed: Sep. 28, 1982

[30] Foreign Application Priority Data

Sep. 29, 1981 [DE] Fed. Rep. of Germany ..... 3138663

[51] Int. Cl.[4] ..... A63F 9/08

[52] U.S. Cl. ..... 273/153 S

[58] Field of Search ..... 273/153 S

[56] References Cited

U.S. PATENT DOCUMENTS 4,415,158 11/1983 Engel ..... 273/153 S

FOREIGN PATENT DOCUMENTS

G8108497 9/1981 Fed. Rep. of Germany ... 273/153 S

G8108498 9/1981 Fed. Rep. of Germany ... 273/153 S 55-3956 1/1980 Japan ..... 273/153 S

*Primary Examiner*—Anton O. Oechsle

*Attorney, Agent, or Firm*—Lewis H. Eslinger

[57] ABSTRACT

A three dimensional toy puzzle of the type wherein the pieces of the puzzle which are formed in layers can be slidably moved about the surface of an inner fastening means. The puzzle has an outer configuration of a crystal with each layer or face thereof having a particular color or indicia to indicate the positioning of each piece contained therein. Another embodiment discloses a puzzle in the shape of a 5 by 5 cube positioned about the inner fastening means with each face of the cube having a particular indicia or other identifying characteristic, and each layer of the puzzle capable of rotation about X, Y and Z axis thereof.

34 Claims, 54 Drawing Figures

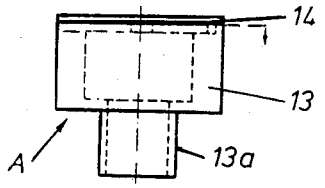
FIG. 8
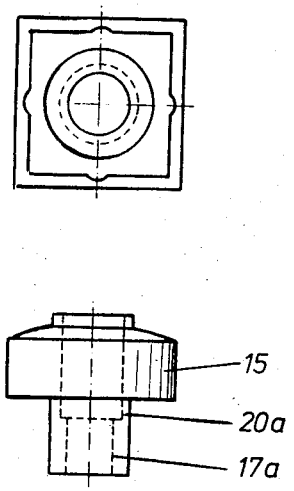
FIG. 9
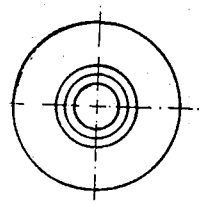
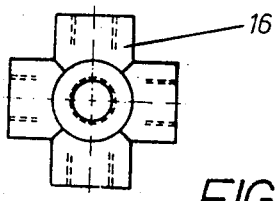
FIG. 10
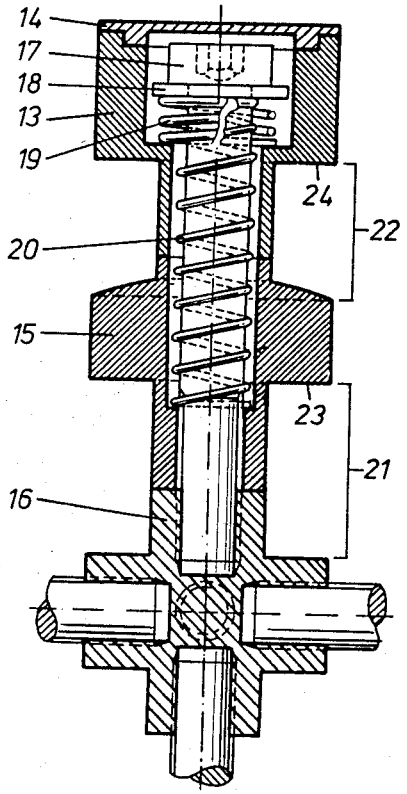
FIG. 11

FIG. 35
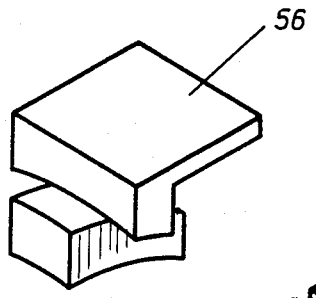
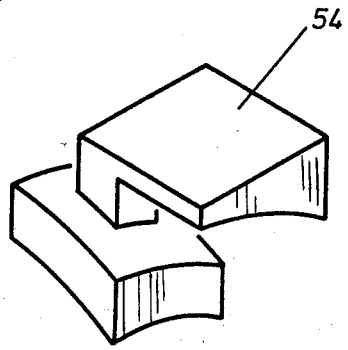
FIG. 34
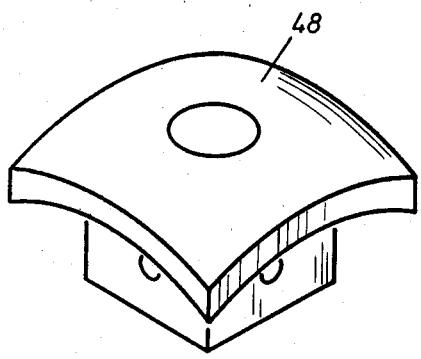
FIG. 36

THREE DIMENSIONAL PUZZLE

BACKGROUND OF THE INVENTION

1. Field of the Invention

The present invention relates to a three-dimensional puzzle and, more particularly pertains to a puzzle game wherein outer surface pieces are circumferentially movable relative to an inner core. The pieces have indicia applied thereto in order to designate relative positions of the pieces to thereby indicate the various arrangements thereof.

2. Discussion of the Prior Art

Numerous types of three-dimensional puzzles have become well known throughout the world. One such puzzle sold by Ideal Toy Corporation under the trademark "Rubik's Cube", and disclosed in Hungarian Pat. No. 170062, is of a three-dimensional puzzle in the shape of a "3-by-3" cube. The cube consists of six sides, each side consisting of a 3 by 3 matrix of sub-cubes or cubies, which are aligned in columns and rows. A grouping of cubes can be rotated about the X, Y, or Z axes of the cube. In this manner a puzzler can move the cubies into any desired position.

SUMMARY OF THE INVENTION

It is an object of the present invention to create a three-dimensional puzzle which, on the one hand, serves to entertain and, on the other hand, sharpens and improves the faculties of logical thought and spatial combination.

Another object of this invention is to create a three-dimensional puzzle which is more difficult to solve than other existing three-dimensional puzzles.

The foregoing objects are met by the puzzle according to the present invention, which can have the form of a star-shaped crystal or cube. A crystal according to the present invention is subdivided into five slices or layers which can be rotated, individually or jointly, around a central point of rotation located in the center of the puzzle, in any one of three dimensions and along planes which are parallel to the aforementioned sectional planes. The subdivisions cut the crystal into eighty-one individual blocks or pieces; the rectangular, triangular and square outer surfaces of sixty-two of these blocks forming the outer surface of the crystal form of the puzzle. Of the five three-dimensional layers, the contiguous surfaces of the two outermost layers, as measured from the internal point of rotation, are each formed by a square, four rectangles and four equilateral triangles; the surface of the adjacent layer thereto consisting of four rectangles and twelve equilateral triangles, and the middle most layer consisting of four squares and eight rectangular blocks or pieces.

As far as the overall mechanism of the puzzle is concerned, the central, internal point of rotation may be formed by a metal sphere on whose surface the above-mentioned sixty-two building blocks, together with twelve additional hidden blocks, are fastened thereto by means of built-in, magnetic elements. As an alternative, the six building blocks with square outer surfaces may also be mounted or attached in such a way that they can be rotated about the surface of the sphere, i.e. by means of a bolt and spring mechanism for attaching a number of pieces to the sphere.

Another preferable embodiment of the invention is based on a three-dimensional central piece in the form of a cross, located in the center of the crystal and acting collectively as the point of rotation. This central piece may be a six-armed central cross, consisting of thirteen blocks, forming a fixed framework into which the other blocks are inserted by means of cams, tenons, or any other suitable mechanical or magnetic means.

It is also advantageous, for this particular embodiment, to equip the building blocks which constitute the central cross with tension elements (e.g. springs) in order to prevent any loss or loosening of the building blocks from the sphere during any and all rotation thereabout.

The objective of the puzzle is to arrange or to solve all the squares, rectangles and triangles on the surface of the crystal; i.e. to move the pieces from a scrambled to an orderly arrangement, one in which typically all the surfaces with equal colors, patterns, decorations or other indicia are adjacent or aligned relative to one another. The development of the game is characterized by the fact that, by means of a one-quarter, one-half or three-quarter rotation (the latter corresponding to a one-quarter rotation in the opposite direction) any of the layers can be moved in three dimensions relative to the other layers, whereby the square, rectangular or triangular surfaces with their various colors, patterns or decorations, are accordingly scrambled across the surface of the crystal. When a similar scrambled pattern has been achieved, the player will subsequently move the pieces about the surface of the crystal to try to bring the mixed-up surfaces back to their original position, i.e. he will try to restore the initial outward appearance of the crystal.

With the particular inner mechanism of the present invention it is possible for all square, rectangular and triangular surfaces to rotate in all three dimensions, i.e. they are capable of circumscribing the crystal. In the course of the game this is achieved when, after the rotation of the one layer has been completed, a layer perpendicular to the first one is moved. The rotation of a layer is considered complete when, as a result of the rotational movement, the crystal has regained its original shape.

In order to recognize or distinguish the surfaces of the crystal, other means besides colors can be used, e.g. symbols. The number of markings used can also be chosen at will in order to vary the degree of difficulty of the puzzle.

In another embodiment of the invention the tops of some of the blocks of the crystal are altered in such a way that the original crystal puzzle assumes the overall shape or form of a three-dimensional cross. Other changes in the outer surfaces of the sixty-two blocks make further modifications of the structure or surface of the puzzle according to the present invention possible. These variations can be treated as described above, with the more difficult shapes adding to the overall aesthetic appearance of the puzzle.

BRIEF DESCRIPTION OF THE DRAWINGS

The foregoing and other objects, advantages and characterizing features of the present three-dimensional puzzle will become apparent from the following detailed description of illustrative embodiments thereof, taken in conjunction with the accompanying drawings wherein identical reference numerals denote like parts throughout the various views, and in which:

FIGS. 6 and 6*a* are perspective views of the inner sphere and part of the block envelope, respectively, which is positioned around it, with the axes of rotation about the sphere indicated on the sphere and on the internal sides of the blocks;

FIGS. 8, and 8*a* are top and side views, respectively, of the upper part of the six-armed central cross;

FIGS. 9, and 9*a* are top and side views, respectively, of an intermediate part 15 of the six-armed central cross;

FIG. 10 is a side view of the center piece of the six-armed central cross;

FIG. 11 is the cross-sectional side view, with portions broken away of a single arm of the cross as attached to the center piece;

FIGS. 17, 18, 19, 20 and 21 are top views of the central core having subsequent layers of blocks attached thereto;

FIGS. 31, 32, 33, 34, 35 and 36 are views of building blocks used in the cube embodiment of the present invention.

DESCRIPTION OF THE PREFERRED EMBODIMENTS

Referring now to FIGS. 1 to 6 an embodiment of the three-dimensional puzzle according to the present invention is shown in which a total of sixty-two of the building block types, 2, 3, 4 and 5, rotate around a metal sphere 1 which functions as the central point of rotation. These blocks form, with their square, rectangular and triangular outer surfaces, the outer surface of the crystal puzzle.

The elements 2, 3, 4 and 5, together with twelve hidden building blocks 6 (see FIG. 3) are held to the ball by means of built-in magnetic elements. The magnetic element need not be provided for building blocks 6 because these blocks are held in place by adjacent overlying building blocks 2, 3, 4 or 5.

Figure 1:
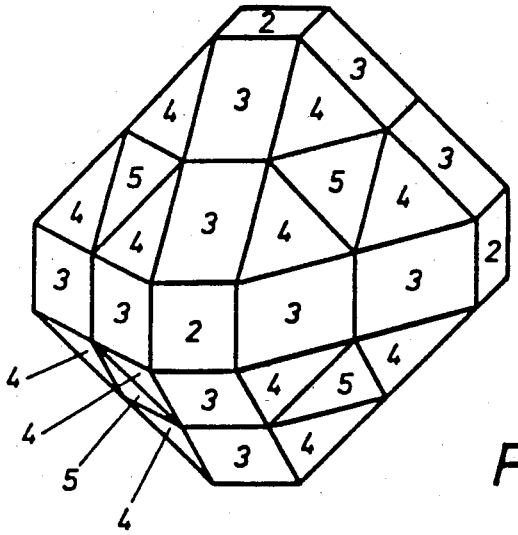
FIG. 1 is a perspective view of an embodiment of the present invention, also showing representational marking for the indicia on the various exposed or outer surfaces of the blocks.
Figure 2:
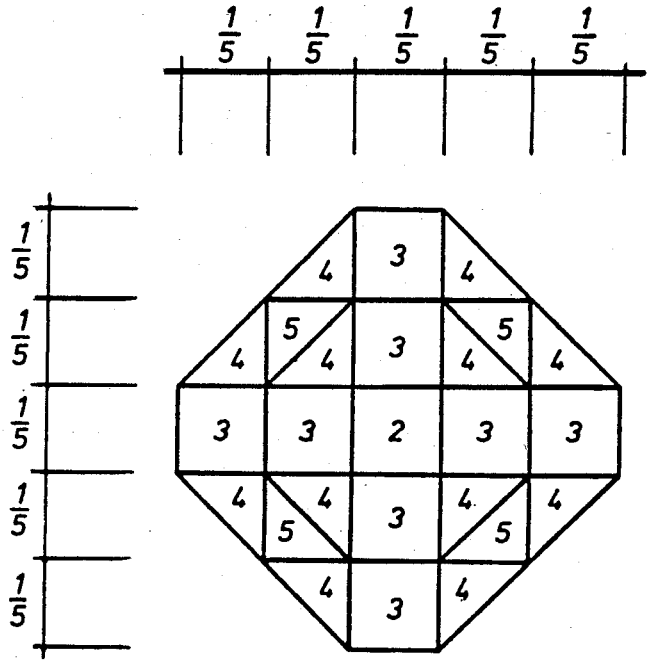
FIG. 2 is an elevational view of one side of the puzzle of the embodiment of FIG. 1.
Figure 3:
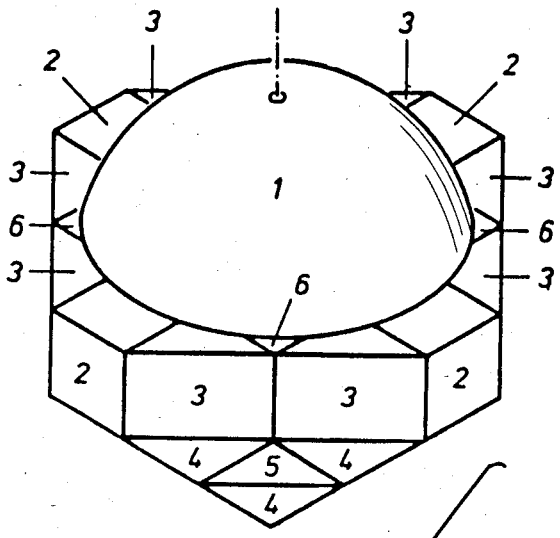
FIG. 3 is a perspective drawing of the embodiment of FIG. 1 partially disassembled so as to expose the inner structure of the three-dimensional puzzle according to the present invention.
Figure 4:
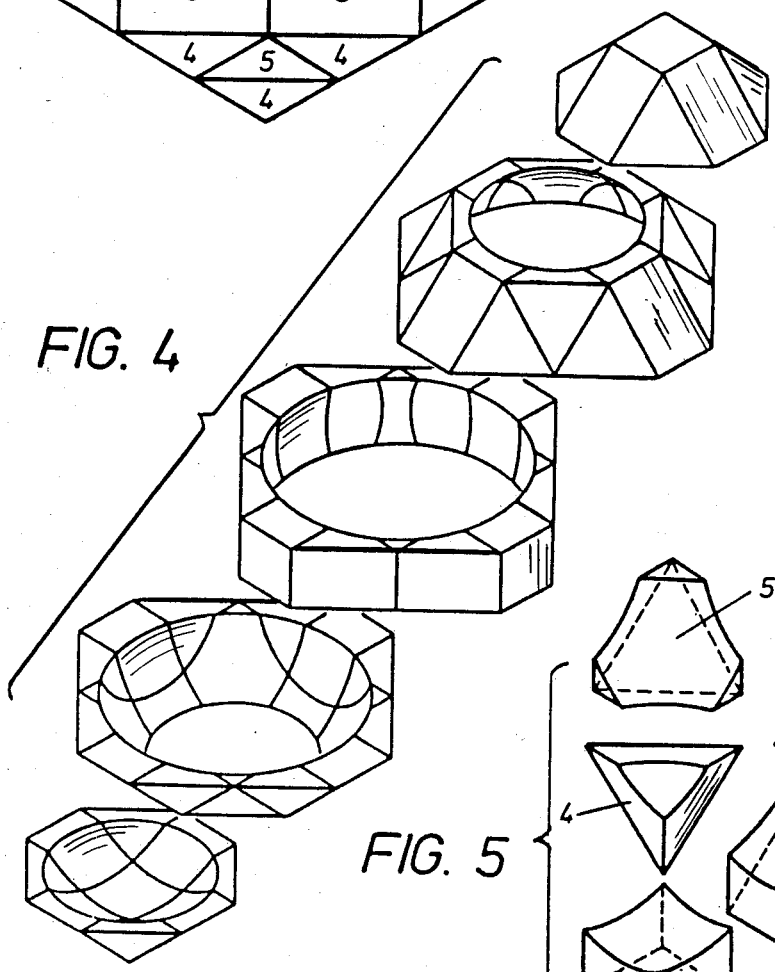
FIG. 4 is an exploded drawing of the building blocks used in this embodiment of the present invention.

FIG. 2 shows a representation of the embodiment according to FIG. 1 to FIG. 6, detailing the subdivision into slices or layers, over two dimensions. Each of the building blocks 2, 3, 4, 5 and 6 (hidden) in the puzzle simultaneously belongs to three such layers. The layers are perpendicular to one another.

Figure 5:
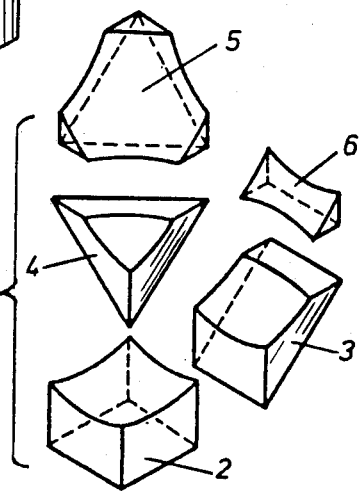
FIG. 5 is a perspective drawing of the individual block types used in the crystal embodiment.

FIG. 5 shows the five types of building blocks used in the embodiment according to FIG. 1 to FIG. 6. To form the surface of the crystal, or "spherical envelope", the following building blocks are required: six of block type 2 which has an outer face substantially square in shape, twenty-four building blocks of type 3 which has a rectangular outer face, and twenty-four of type 4 and eight of building block 5, each having a triangularly shaped outer face and twelve of building block 6.

Figure 6:
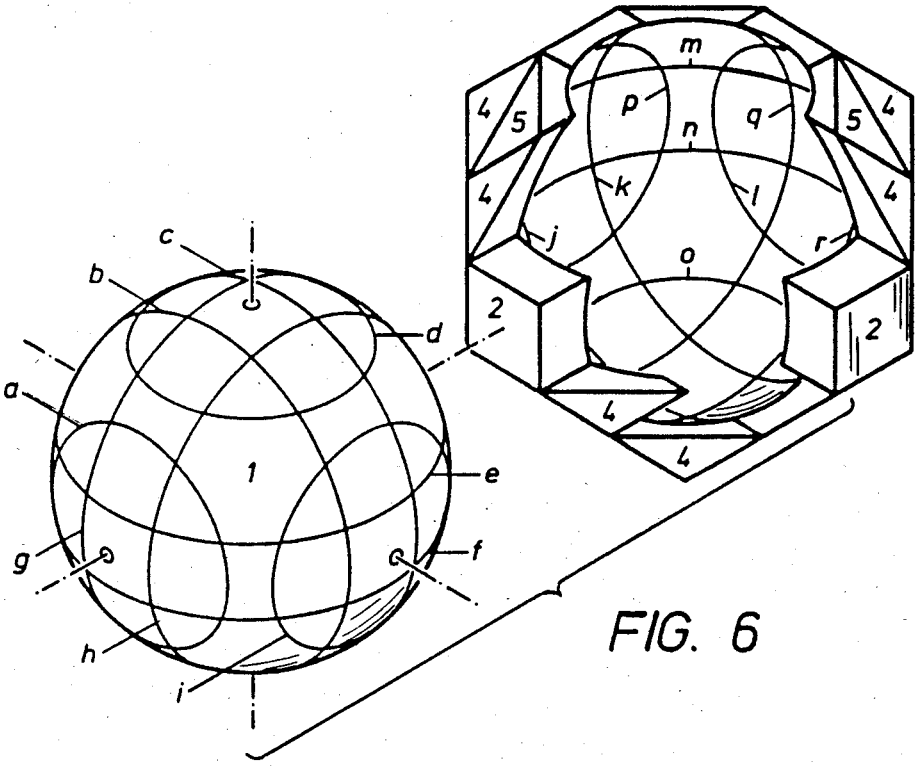

FIG. 6 is a perspective view of the inner sphere 1 while FIG. 6*a* illustrates a portion of the "building block envelope" surrounding it. The letters a-b-c-d-e-f-g-h-i in these drawings serve to indicate the planes of rotation X, Y and Z which are perpendicular to one another, j-k-l, m-n-o and p-q-r serve to indicate the sectional planes of the subdivision of the surface of the crystal into layers. The planes of rotation and the sectional planes coinciding with the various three-dimensional subdivisions are geometrically identical.

Figure 7:
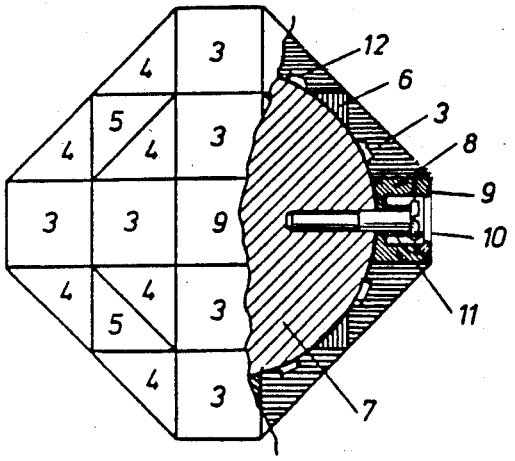
FIG. 7 is a side view, partially in cross-section, of another embodiment of the three-dimensional puzzle according to the present invention.
Figure 12:
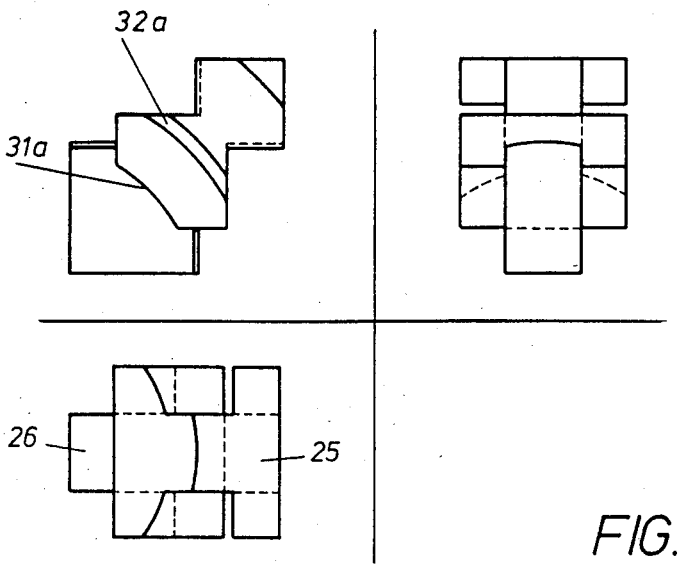
FIG. 12 shows the top, side and front views of a building block fastenable to the central cross.
Figure 13:
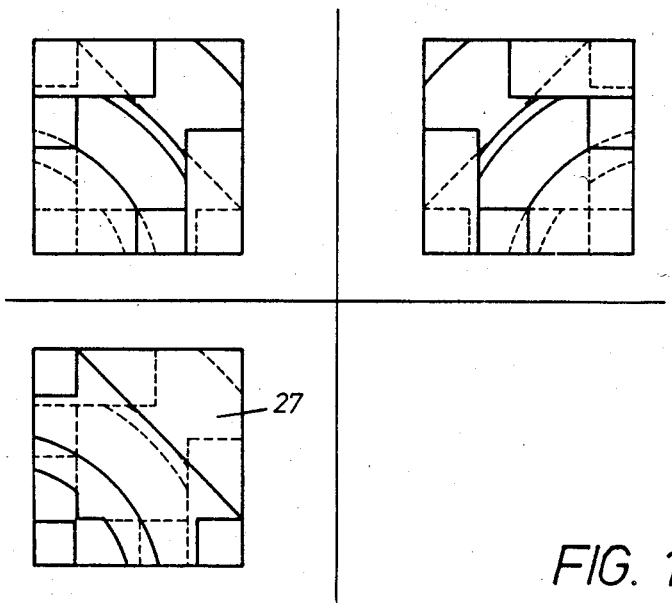
FIG. 13 shows the top, side and front views of another building block of the present invention.
Figure 14:
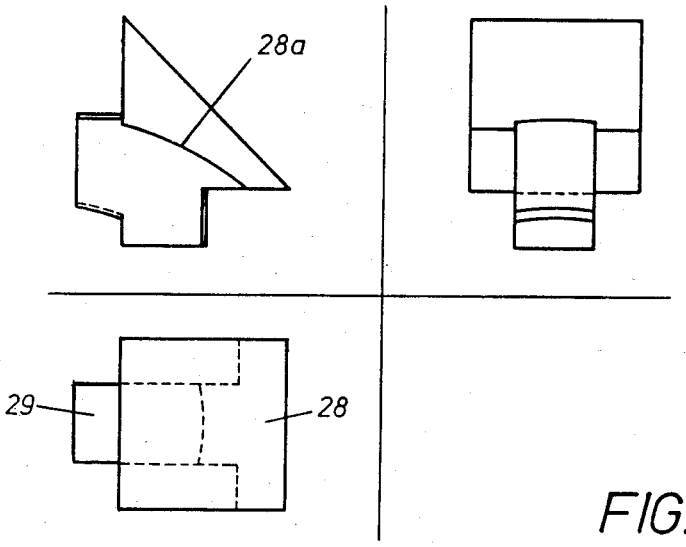
FIG. 14 shows the top, side and front views of a building block fastenable to the central cross.
Figure 15:
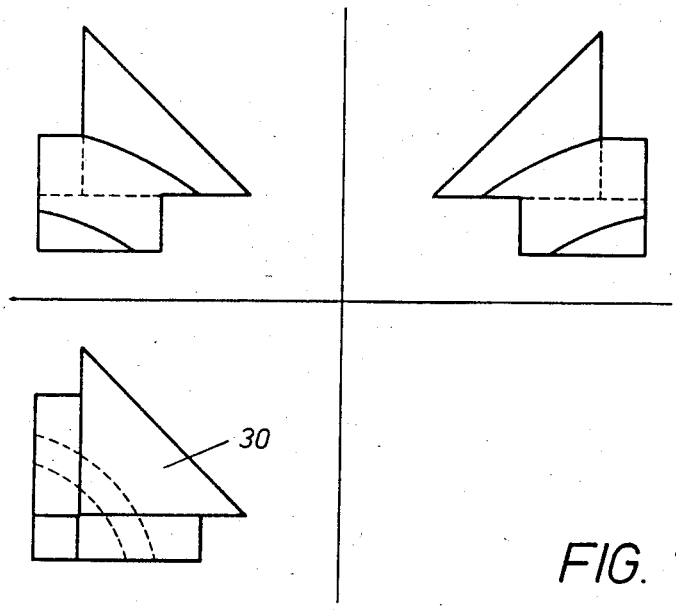
FIG. 15 shows the top, side and front views of a building block of the present invention.
Figure 16:
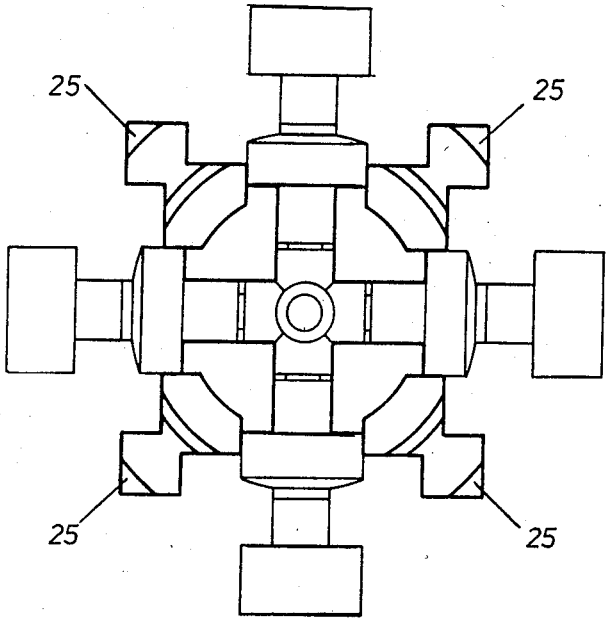
FIG. 16 is a top view of the central cross piece with four arms extending in two dimensions therefrom and with building blocks positioned therebetween.

FIG. 7 shows a variation of the above-described embodiment of the three-dimensional puzzle according to the present invention. On a sphere 7, which similarly functions as the central point of rotation, six building blocks consisting of a casing 8 with a curved (or flat) bottom and a separate lid 9, have been fastened by means of a screw 10 and a spring 11, in such a way that they can be rotated in two dimensions. They are surrounded by the same number of building blocks 3, 4, 5 and 6 as in the embodiment according to FIG. 1 to FIG. 6. The building blocks 3, as shown in partial cross-section, contain magnetic elements 12, mounted in any convenient manner on their inner surface, by means of which they are fastened to the surface of the metal sphere 1.

FIGS. 8 to 23 represent the preferred embodiment of the internal fastening means according to the present invention.

FIG. 8 shows a side and a top view of the upper part of a six-armed central cross which can be used as a central body in lieu of the ball or sphere 1. The part A consists of a square upper portion 13 having a cylindrical extension 13*a* extending downwardly therefrom and a separate lid 14, whose outside surface forms one of the six square outer surfaces of the crystal. Part A has an axial bore formed therein including an enlarged recess in portion 13, so that it can hold the head of a screw 17, a washer 18, a spring 19, and the upper part of a small spring 20 with an appropriate diameter, i.e. smaller than the diameter of the spring 19 (FIG. 11).

FIG. 9 shows a side and a top view of one of the intermediate parts 15 of the six-armed central cross. Part 15 has a mushroom-like shape, having a bore 17*a* formed therein receiving the shaft of screw 17, and a recess 20*a* for the insertion of the lower part of spring 20.

FIG. 10 shows a top view and side view of the central-most piece in the form of a cross 16, and is the center of the six-armed central cross. Each of its arms is equipped with a female thread to allow insertion of the end of screw 17.

FIG. 11 shows the arrangement of the parts 13 to 20 mentioned above, in one of the arms of the central cross. The arms each serve as support for building blocks 25 and 28 (FIG. 12 and FIG. 14), which are fastened, i.e. inserted, into the open spaces or grooves 21 and 22 formed between elements 13, 15 and 16. Flanges 23 and 24 function as the locking surfaces for parts 15 and 13, which transfer the restoring force of the pre-tensed springs 20 and 19. When building blocks 25 (described in detail hereinafter) are inserted in the free spaces 21, they tense, with their cams 26, and the spring 20 (spring 19 is being pre-tensed at the same time); and in the meanwhile, the intermediate part 15 is lifted off the cross-shaped piece 16 whereby the restoring force of the spring (or springs) now affects, via flange 23, the cams 26 of building blocks 25. The same process is repeated when building blocks 28 (also described hereinafter) are inserted in the free spaces 22: with their cams 29 they tense the spring 19; the upper part 13, 14 of the intermediate part 15 is raised and the action of the spring can therefore yield a clamping effect, via flange 24 (see also FIG. 16 and FIG. 17). Consequently, by using this configuration, the central cross can effectively anchor various pieces of the puzzle to thereby allow other manipulatable pieces of the puzzle to be movable relative thereto.

In FIG. 12 to FIG. 15, the four types of building blocks 25, 27, 28 and 30 are shown in three views, front, side and top. To form the crystal, the following building blocks are used: twelve pieces of building block type 25, eight pieces of block type 27, and twenty-four pieces each of building blocks 28 and 30.

The inner structure of the crystal is clearly shown in the following figures, i.e. FIGS. 16 to 23, which show the method of mounting, namely the insertion of building blocks 25, 27, 28 and 30 into the central cross which serves as the overall supporting structure.

Figure 17:
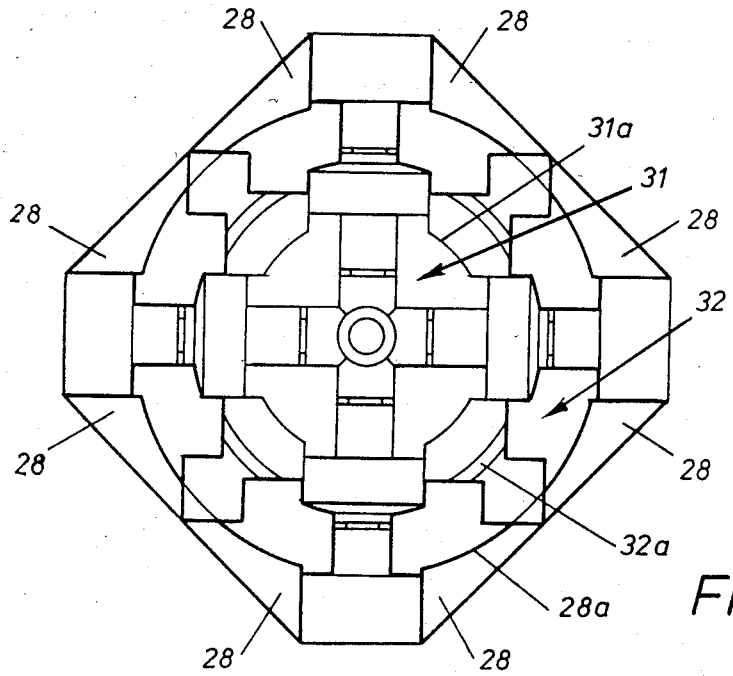
Figure 18:
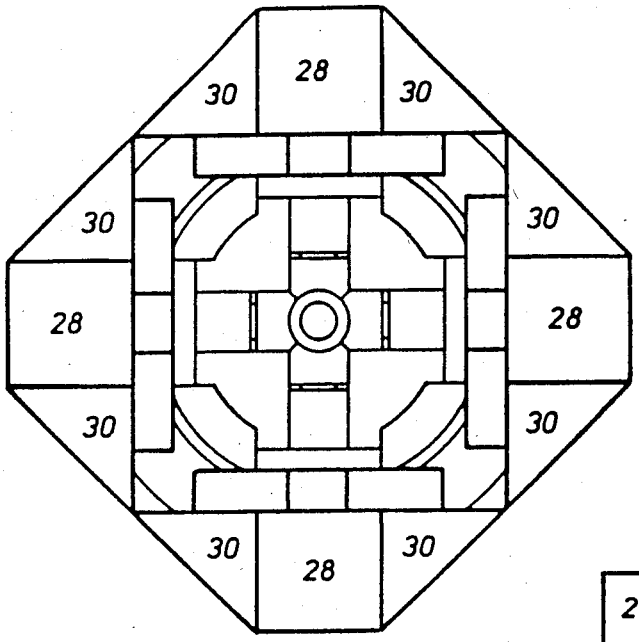
Figure 19:
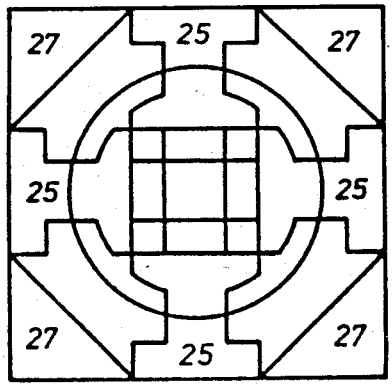

With four of the parts 13 to 15 and 17 to 20, and the cross-shaped piece 16, we construct first a four-armed cross which extends in one plane; subsequently, four building blocks 25 (FIG. 16) and eight building blocks 28 are inserted (FIG. 17), whereby the middle layer of the crystal is completed along the selected plane (FIG. 17).

As is clearly shown therein, an inner circular channel 31 defined by the surfaces 31*a* of blocks 25 and an outer circular channel 32 defined by the surfaces 32*a* of elements 25 and 28*a* of elements 28 are thus provided. These channels are grooved so as to accept and guide the blocks which comprise the next layer to be added.

Figure 20:
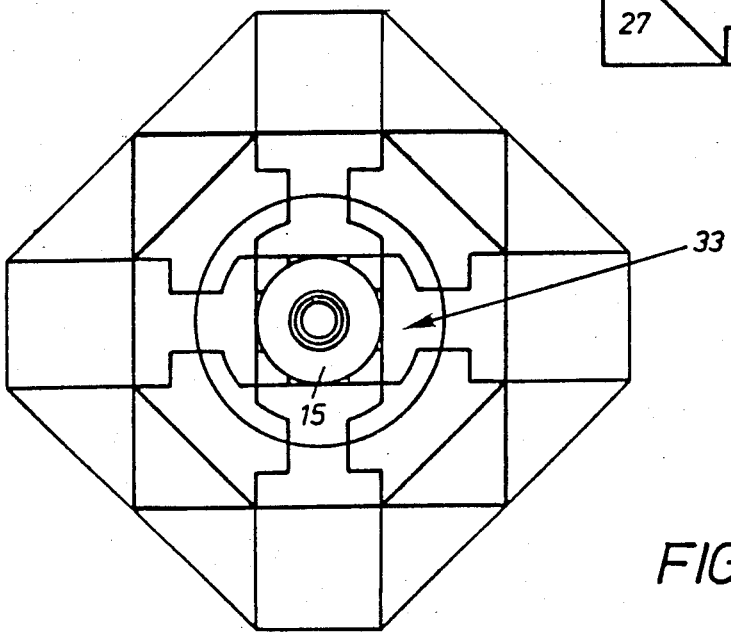

The next layer is formed by inserting the outside blocks 28 and 30 into the channel 32 (FIG. 18), and the layer is then completed by adding what can be called a package (FIG. 19) consisting of four building blocks 25 and 27. This can be preformed to facilitate easy placement of these parts into the puzzle. Finally, an intermediate part 15 is inserted as part of the structure of the fifth arm of the central cross (FIG. 20).

Another inset, circular channel 33 (FIG. 20) is consequently created by this second layer for the acceptance and guidance of a subsequent layer of blocks.

Figure 22:
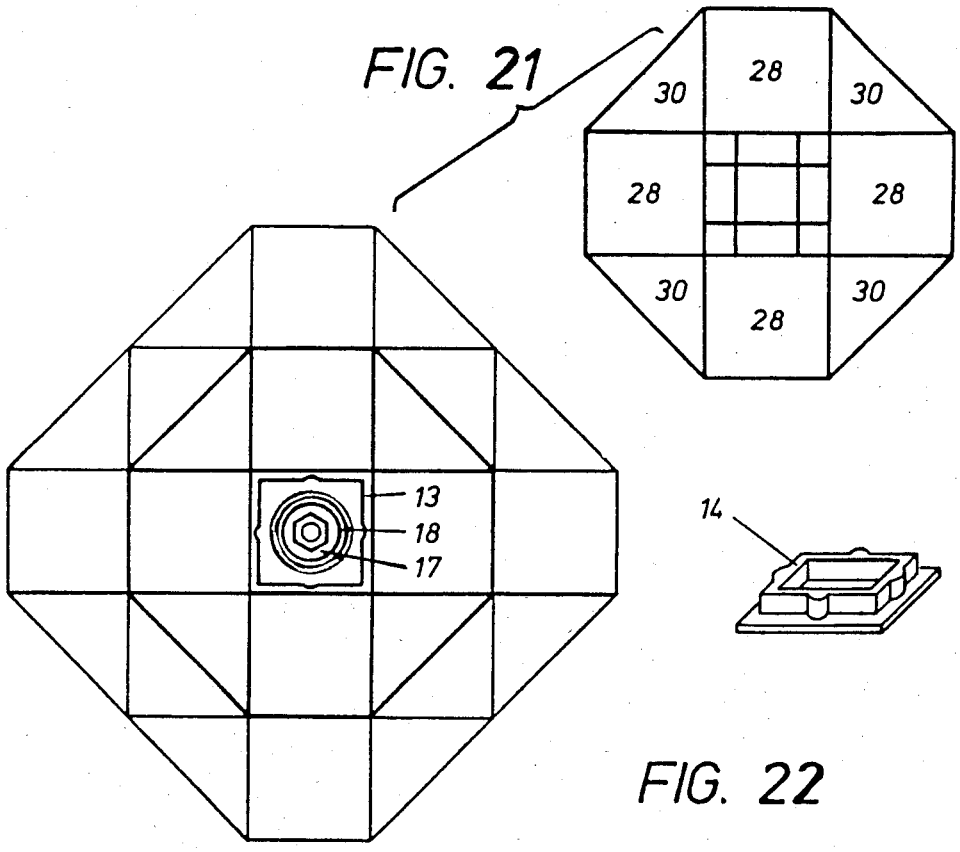
FIG. 22 is a top view of the crystal showing the top part of an uncovered central core arm.

The construction of the last, or outermost, layer of the crystal starts with the insertion of four building blocks 28 and 30 in the channel 33. They can be inserted individually or in the form of the previously mentioned package. The fifth arm of the central cross is then completed by the insertion of the upper part 13, the springs 19 and 20, the washer 18 and the screw 17. Then, lid 14 is put on; it is a detachable part in order to make it possible to take the puzzle apart (FIG. 21 and FIG. 22).

Figure 23:
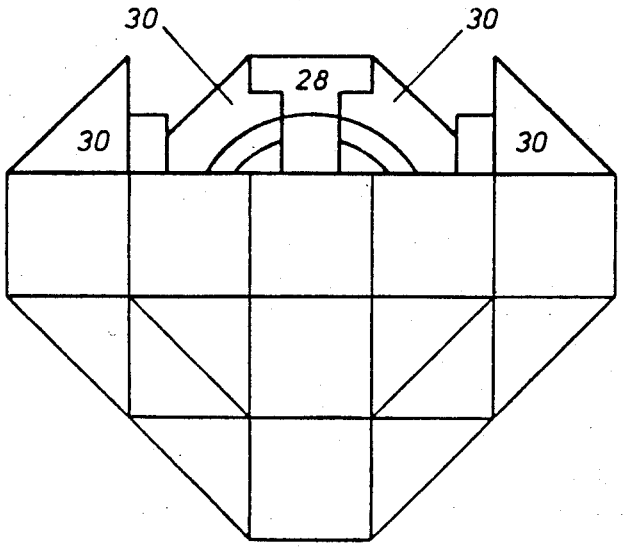
FIG. 23 is a side view of a partially unassembled puzzle.
Figure 24A:
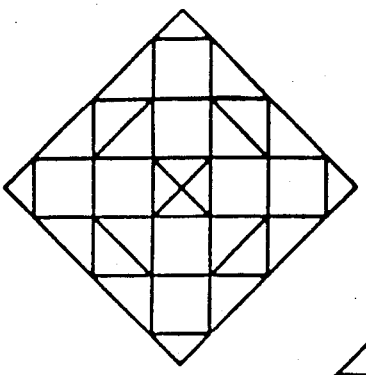
FIGS. 24 (*a–f*) are front views and (*g–h*) are perspective views of various puzzles according to the present invention with building blocks having varying outer exposed surfaces.
Figure 24B:
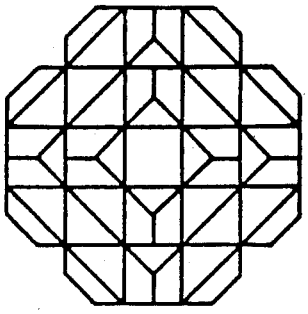
Figure 24C:
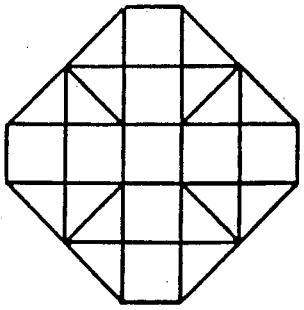
Figure 24D:
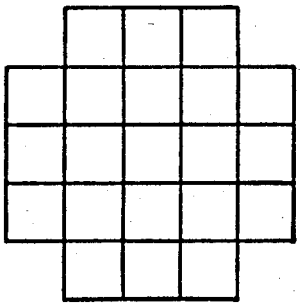
Figure 24E:
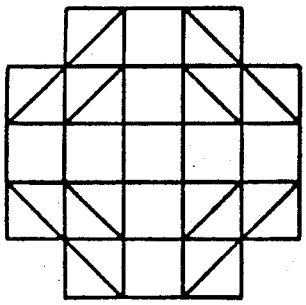
Figure 24F:
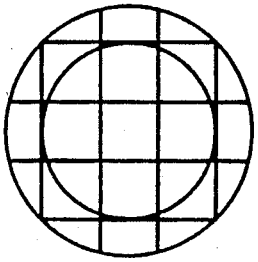
Figure 24G:
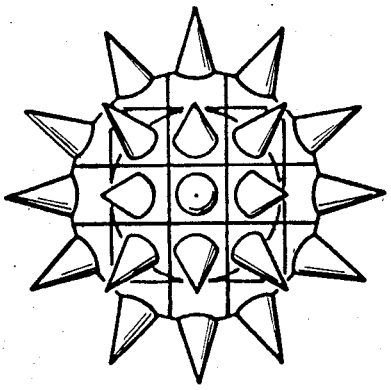
Figure 24H:
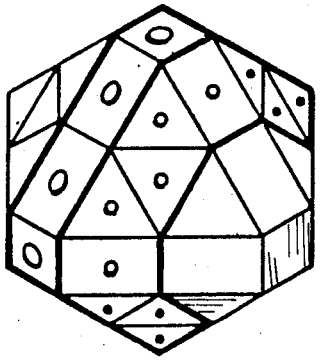

The first "construction" phase of the crystal is herewith completed. The partially constructed puzzle is then inverted and placed on the outside surface of lid 14 (FIG. 23). The mounting process according to FIGS. 18 to 22 is repeated on the opposite side of the puzzle, whereby the construction of the crystal is completed.

FIG. 24 shows different variations of the outer form or shape of the puzzle according to the present invention.

It is to be noted that the above-described cross arrangement is the same in all of the variations, yet the outer surfaces of the building blocks have merely been altered to provide a more aesthetic or educational purpose to the puzzle. Variation A shows each of the six square surfaces of the crystal according to FIG. 8 to FIG. 23, being equipped with a pyramid having a congruent base, whose side surfaces appear as sections of the extensions of four rectangular surfaces on their short sides, located in an outer layer. These pyramids may be attached in a movable or fixed manner, to the square outer surfaces of the relevant building block.

In variation B, each of the twenty-four rectangular surfaces of the crystal according to FIG. 8 to FIG. 23, is equipped with a prismlike (wedge) shape having a congruent base, whose side surfaces appear as figures of sections of the extensions of triangular surfaces adjacent to the long sides of the rectangular surfaces on the side in common with the rotational planes, which touch the rectangular plane with their short sides. These prismlike shapes cannot be moved relative to the building block.

In variation C, all thirty-two triangular surfaces of the crystal according to FIG. 8 to FIG. 23 are equipped with upright (hidden) or leaning pyramids, restricted by planes which appear through the sectioning of the extensions of all twenty-four rectangular surfaces along their long sides, with all the rotational planes of the puzzle. These pyramids cannot be moved relative to the particular building block.

In variation D, all thirty-two triangular and all twenty-four rectangular surfaces of the crystal according to FIG. 8 to FIG. 23, are equipped with attachments restricted by planes which appear through the sectioning of the extensions of all six square surfaces along their sides, with all the rotational planes of the puzzle. These attachments cannot be moved relative to the block to which they are attached.

Variation E is obtained when the four corner cubes of the outer layer of a puzzle according to variation D are sectioned in such a way that the intersecting lines are identical with the diagonals of their visible side surfaces.

Variation F is obtained by reduction of the puzzle size to be bounded by the largest inscribed sphere within variation D.

Variation G is a puzzle based on variation F, with the addition of cones placed on the partial spherical top surfaces of the relevant blocks.

Variation H is a three-dimensional puzzle for blind people, created by adding distinct marking (shown for two layers) to the crystal of the present invention. The markings can be achieved by adding rivets or similar items, or by cutting out grooves, channels, holes, etc. or any other means.

Figure 25:
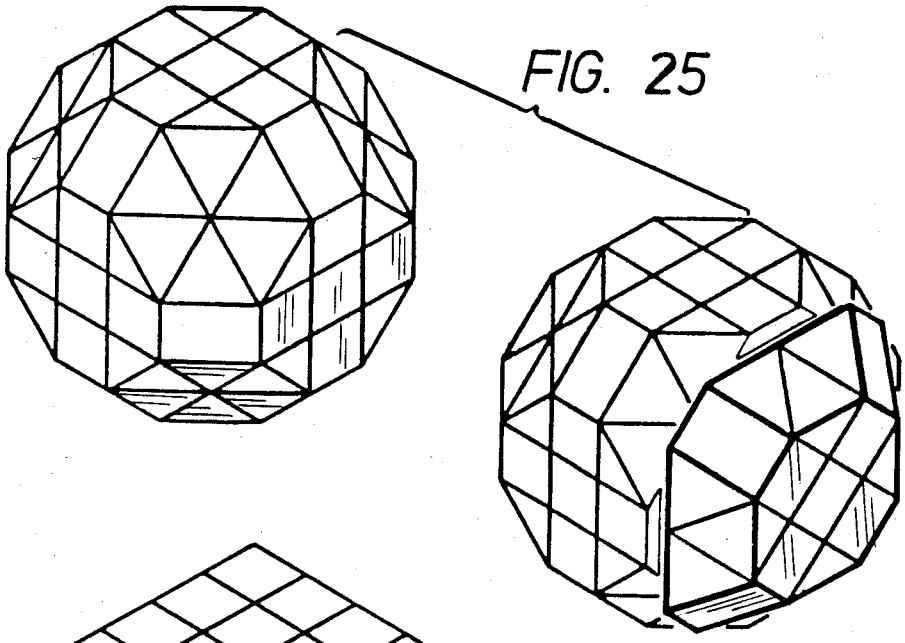
FIGS. 25 and 26 are perspective views of a 5 by 5 spherical shape and a 5 by 5 cube according to teachings of the present invention, each showing a plane of blocks in partial rotation about an axis.
Figure 26:
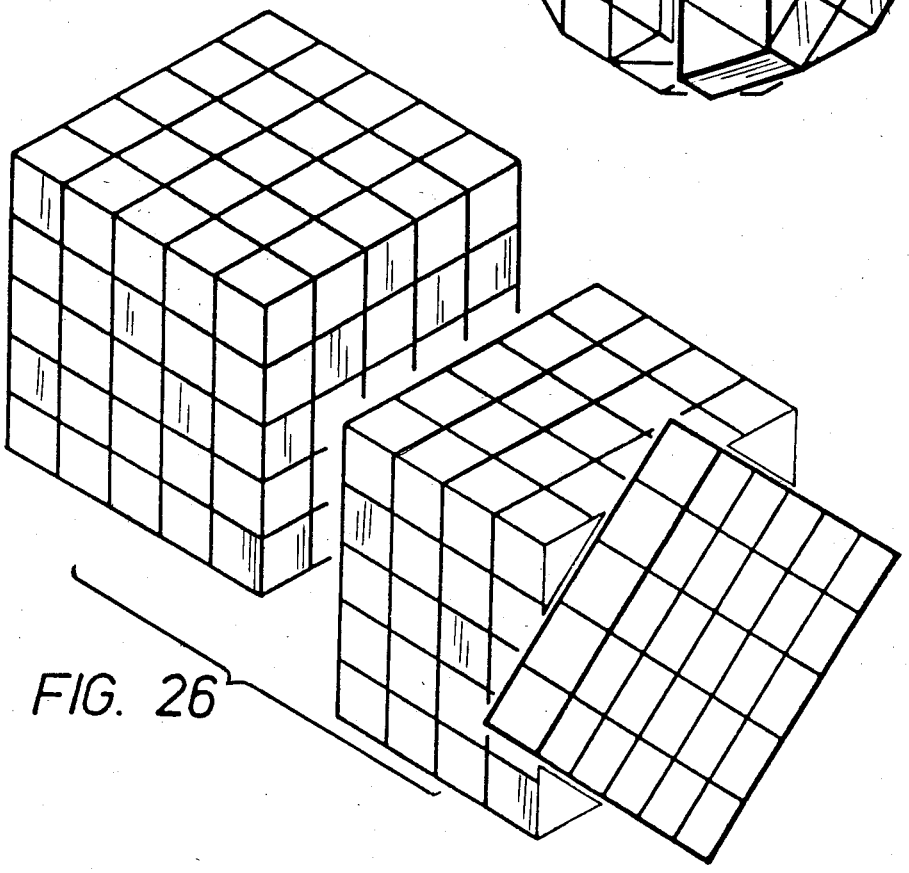

FIG. 25 and FIG. 26 show additional preferred embodiments of the puzzle according to the present invention and additionally show a plane or layer of blocks or cubes in partial rotation along one axis of the crystal.

Figure 37:
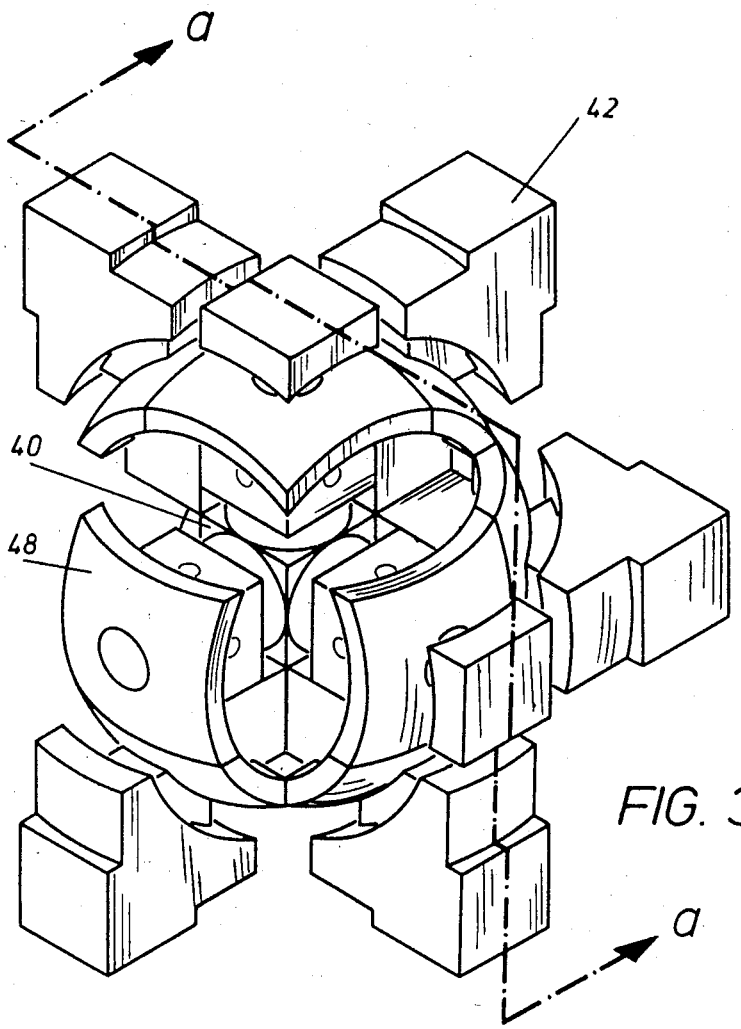
FIG. 37 is a partially sectioned view of the center fastening means having building blocks placed thereon.
Figure 37A:
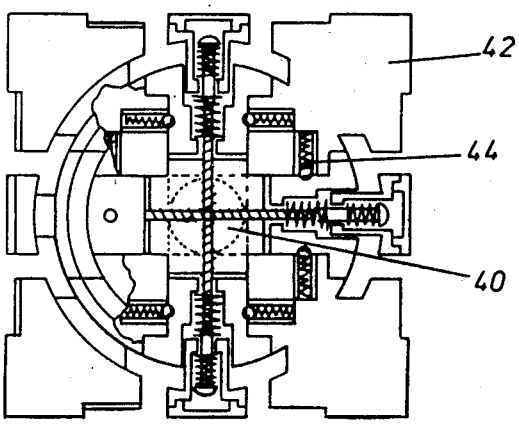

In more particularity, FIG. 26 describes a 5 by 5 cube having an internal mechanism of the present invention as shown in FIGS. 11 and 37. The center piece, shown at 40, shows three arms of the cross in cross-section showing the internal screw-spring mechanism as described hereinabove. Further, middle edge element 42 is provided with spring-loaded bearings 44 to ease in rotational movement and alignment about the central cross. The middle edge elements 42 act as the foundation for the placement of the remaining blocks which make up the individual layers of the cube according to the teachings of the present invention. FIG. 36 shows the top of the intermediate head piece 48 which attaches to the arm of the inner fastening means through the screw-spring mechanism. This piece aids in anchoring the other pieces of the puzzle cube to the inner fastening means.

The cube embodiment is further comprised of eight corner elements 50, twelve middle edge elements 42 as described above, twenty-four corner edge elements 52, twenty-four corner field elements 54 and twenty-four edge field elements 56 which, when properly arranged about the inner fastening means, can all rotate about the X, Y and Z axis of the center cross and, hence, about the cube.

In order to assemble a cube about the central piece 40, as stated above, four co-planar arms of the cross are assembled including headpieces 48 attached thereto. Middle edge elements 42 are inserted between the arms of the cross and are anchored therein. Subsequently, edge field elements 56 are placed in the spaces formed between the headpieces and the middle edge elements 42. In this manner the middle layer is formed to which subsequent intermediate layers of corner edge elements 52, corner field elements 54, and edge field elements 56 can be added on either side thereof. Finally, an external layer is added to these intermediate layers by adding corner elements 50, middle edge elements 42 and corner edge elements 52 to the channel formed in the intermediate layer. Subsequently, four corner field elements 54 and edge field elements 56 are added into the square space formed within the external layer. This placing of elements then allows for the completion of the headpiece 48 including the internal spring structure. A top 14 can then be added to headpiece 48 to finish the construction of the six arms of the center piece 40 and thereby complete the formation of the 5 by 5 cube according to the teachings of the present invention.

Figure 27A:
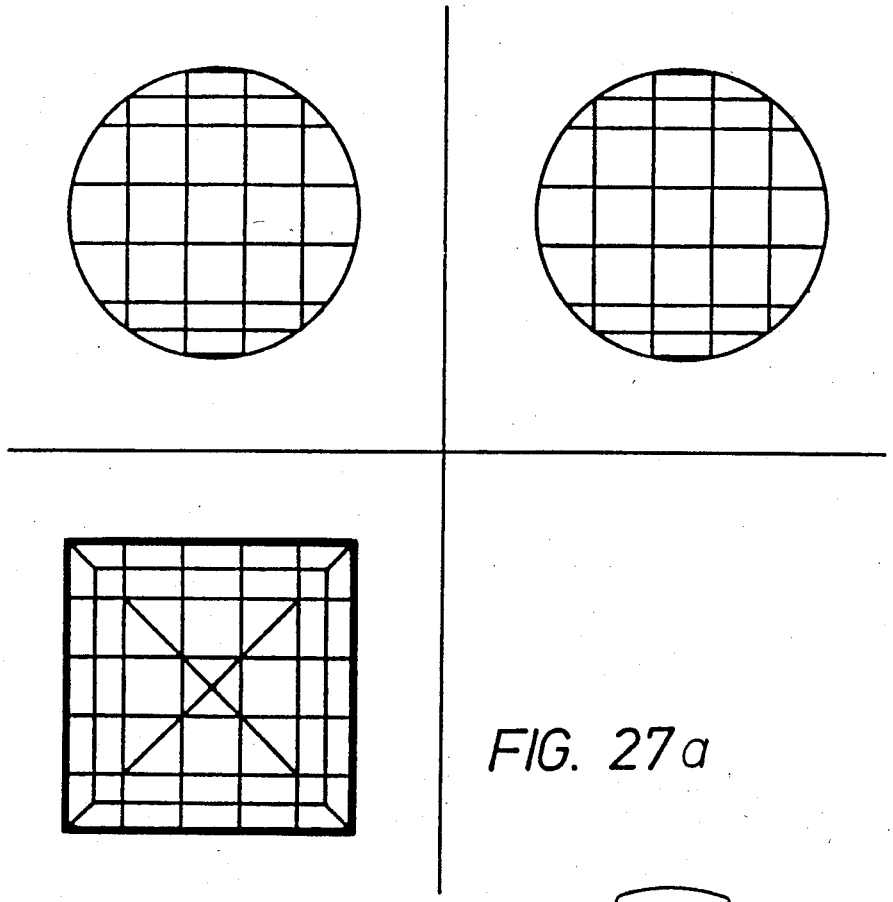
FIGS. 27*a*–27*c*, 28*a*–28*c*, and 29 are various views of other puzzles according to the present invention having blocks with differing outer surface shapes.
Figure 27B:
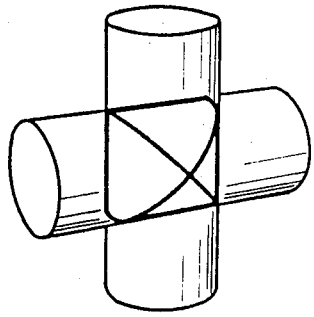
Figure 27C:
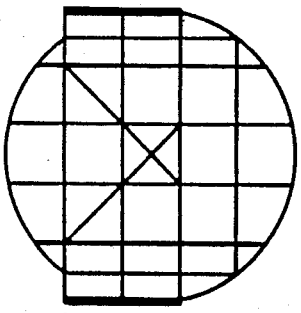

FIG. 27 shows an embodiment in which the shape of the puzzle results from the intersection of two circular cylinders of equal thickness, whose axes form a cross of coordinates with 90° angles. Drawing a shows three projections of the puzzle, drawing b shows a three-dimensional view, and drawing c presents a top view of the same puzzle, after three of its layers have been rotated.

Figure 28A:
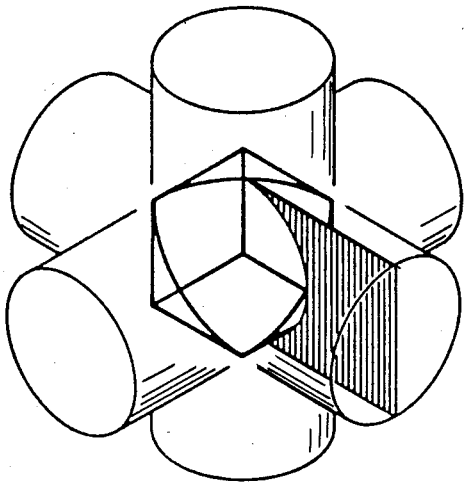
Figure 28B:
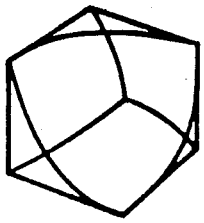
Figure 28C:
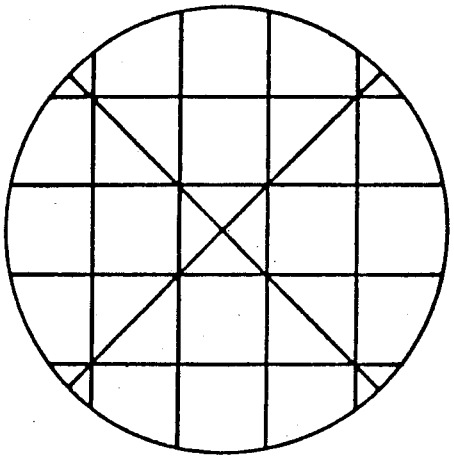

FIG. 28 shows an embodiment in which the shape of the puzzle results from the intersection of three circular cylinders of equal thickness, whose axes form a three-dimensional cross of co-ordinates having 90° angles. Drawing a and b represent the configuration of the intersection, drawing c is a plan view of this embodiment and in accordance with the teachings of FIGS. 3 to 7.

Figure 29:
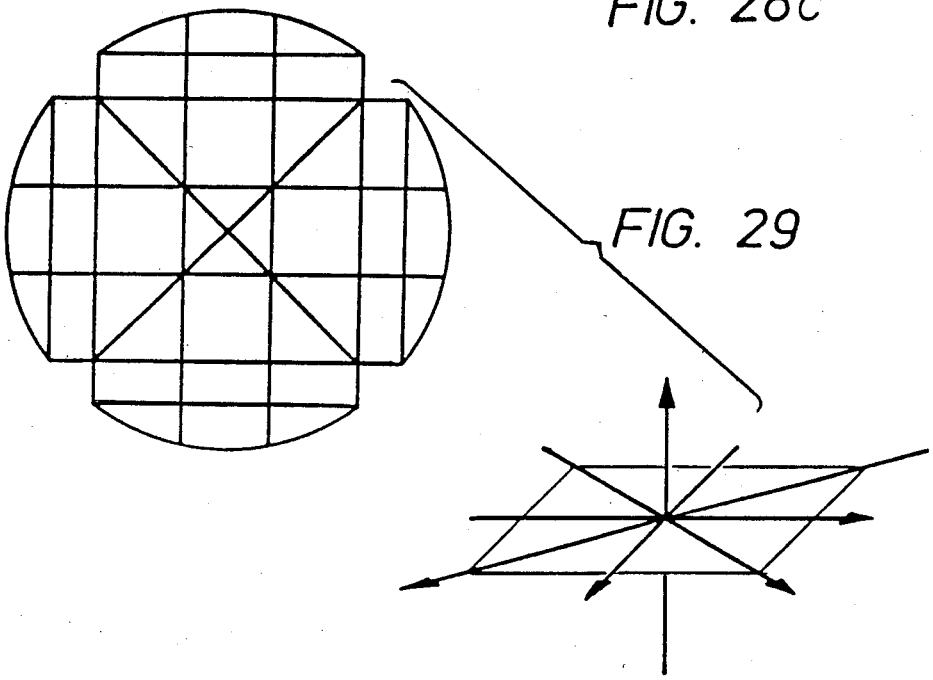

FIG. 29 is a variation of the embodiment of the puzzle according to FIG. 28. Contrary to the previous manner of execution, the puzzle is subdivided—i.e. the building blocks are arranged—in such a way that adjacent axes of rotation falling in the same plane are always at 45° angles with regard to one another.

Figure 30:
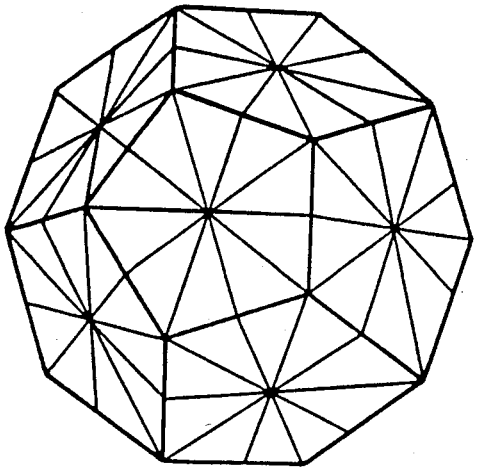
FIGS. 30 and 30*a*–30*c* are views of another puzzle embodiment according to the present invention in which the planes of rotation of the building blocks have a pentagonal surface.
Figure 30A:
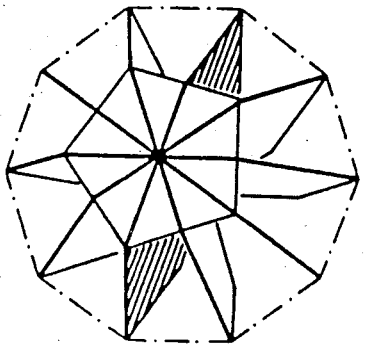
Figure 30B:
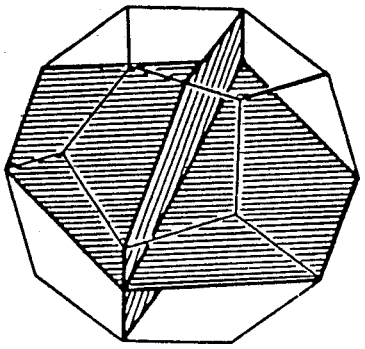
Figure 30C:
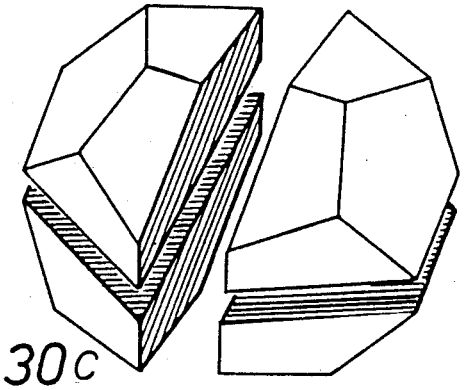
Figure 32:
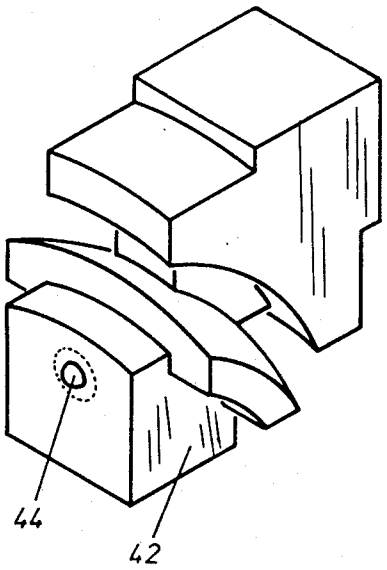
Figure 33:
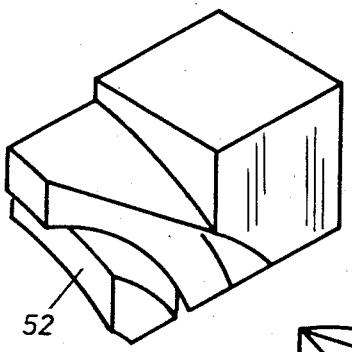
Figure 31:
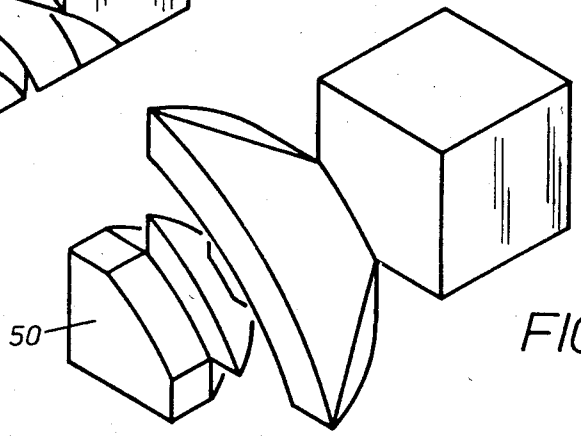

FIG. 30 shows an embodiment of the three-dimensional puzzle according to the present invention, in which the puzzle has been divided in such a way that none of the axes of rotation are perpendicular to each other. Drawing a shows the planes of rotation of the building blocks of a pentagonal surface. Drawings b and c show that each plane of rotation belongs always to an opposite "pentagonal pair". The rotational planes end at the outer surfaces or faces of the pentagonal pieces and at the lines which cut the pentagonal surfaces of the puzzle in half.

From the foregoing it is apparent that the objects of the present invention have been fully accomplished. As a result of the present invention, a three-dimensional puzzle has been provided. Although a preferred embodiment of the principles of this invention has been described and illustrated in detail herein, it should be realized that the same are not limited to the particular configuration shown in the drawings, and that modifications thereof are contemplated and can be made without departing from the broad spirit and scope of this invention as defined in the appended claims.

What is claimed is:

1. A three-dimensional puzzle in the form of a geometric body, comprising at least five layers of equal thickness of which a minimum of two layers are adjacent and which are movable with regard to each other, said body having the shape of a crystal which, at least on the surface, is subdivided into said at least five layers which run parallel to each other and which, in turn, are intercut, at least on the surface of the body into at least five perpendicular layers, and central cross means interconnecting said layers for permitting all the layers running parallel to each other to be moved with regard to each other, said central cross means including a center element formed as a six-armed cross, a plurality of intermediate parts, and a plurality of end parts, one each of said intermediate and end parts being serially arranged and resiliently fastened to each of said arms of said center element, said center part, said intermediate part, and said end part forming a plurality of free spaces arranged to receive a plurality of movable inner building blocks for supporting said layers.

2. A three-dimensional puzzle according to claim 1, characterized by the fact that the crystal has at least six truncated points which form the ends of said central cross means.

3. A three-dimensional puzzle according to claim 2, characterized by the fact that said central cross means is arranged for making rectilinear connections between the truncated points, in which each half of said six-armed cross extends on either side of a central point where the connections intersect.

4. A three-dimensional puzzle according to claim 3, characterized by the fact that the connections fall into at least two planes, which are perpendicular to one another.

5. A three-dimensional puzzle according to claim 4, characterized by the fact that the connections are perpendicular to one another.

6. A three-dimensional puzzle according to claim 4, characterized by the fact that the connections falling into the same plane are perpendicular to one another.

7. A three-dimensional puzzle according to claim 4, characterized by the fact that the connections falling into one plane form an acute angle with the plane formed by the other connections.

8. A three-dimensional puzzle according to claim 7, characterized by the fact that equilateral, multiangular planes extend between the truncated points.

9. A three-dimensional puzzle according to claim 2, characterized by the fact that each of said intermediate parts is formed substantially cylindrically and having a mushroom-shaped head and a round shank and resiliently interacts with the next adjacent end part and arm of said six-armed cross.

10. A three-dimensional puzzle according to claim 9, characterized by the fact that each intermediate part has been pre-tensed by a spring means with regard to the adjacent end part and with regard to said center element.

11. A three-dimensional puzzle according to claim 3, characterized by the fact that said intermediate parts and said end parts include tube sections arranged to contain multisprings whose ends have a spring effect upon flanges formed in each side of said tube sections.

12. A three-dimensional puzzle according to claim 2, characterized by the fact that the outer layer building blocks are guided, with regard to one another, along at least three spherical channels formed in said inner building blocks which, with regard to one another, run in coplanar fashion at various distance from said central cross means.

13. A three-dimensional puzzle according to claim 12, characterized by the fact that inner building blocks run uninterruptedly with regard to one another along guides formed by said intermediate and end parts, whereby said guides affect one another under the influence of the springs.

14. A three-dimensional puzzle according to claim 13, characterized by the fact that, underneath the visible triangular and rectangular surfaces, there are 12 inner building blocks for the support of the visible outer layer building blocks.

15. A three-dimensional puzzle according to claim 1, characterized by the fact that each layer consists of outer layer building blocks whose outside faces form flat triangles and squares and which, with regard to one another, are movable along orbital sections of said crystal.

16. A three-dimensional puzzle according to claim 15, characterized by the fact that said crystal is formed with six truncated points and eight flat triangles which extend between equatorial planes, and consists of a total of sixty-eight outer layer building blocks which extend between the three-dimensional cross and of which fifty-six blocks have triangular or square outside faces.

17. A three-dimensional puzzle according to claim 15, characterized by the fact that there are twenty-four outer layer building blocks whose outside faces are equilateral triangles.

18. A three-dimensional puzzle according to claim 15, characterized by the fact that there are twenty-four outer layer building blocks whose outside faces are rectangular; the length of the long side of these rectangles corresponds to the length of one of the sides of said triangles, and wherein said end parts are formed having a square end arranged at each of six truncated ends of said crystal in which the short side corresponds in length to one of the sides of said squares constituting part of the truncated points.

19. A three-dimensional puzzle according to claim 18, characterized by the fact that the outer layer building blocks with the rectangular outside faces have their long sides adjacent to the sides of the triangles.

20. A three-dimensional puzzle according to claim 19, characterized by the fact that two rectangular surfaces belonging to different planes, are connected with each other by way of triangular surfaces.

21. A three-dimensional puzzle according to claim 20, characterized by the fact that, near the truncated points, there is each time a triangular surface in between two rectangular surfaces.

22. A three-dimensional puzzle according to claim 15, characterized by the fact that the surfaces which belong together bear surface markings to indicate the fact that they belong together.

23. A three-dimensional puzzle according to claim 22, characterized by the fact that the surface markings, by means of color effects, set those surfaces apart which belong together.

24. A three-dimensional puzzle according to claim 22 characterized by the fact that the outer surfaces have a portion which upwardly extends therefrom.

25. A three-dimensional puzzle having a geometric shape, said puzzle comprising an inner fastening means including a center element formed as a six-armed cross with each arm thereof receiving a respective one of a plurality of intermediate parts and end parts; said center element, said intermediate parts, and said end parts forming a plurality of free spaces arranged to receive additional fastening means; at least twenty building blocks, each block having an outer face, the combination there of along with the outer surfaces of the end parts forming the geometric shape of said puzzle, said blocks being positioned on and attached to said inner and additional fastening means, said blocks having means for movement about the axes of said cross; said blocks being positioned in layers, said layers being of equal thickness and in relative parallel relationship.

26. A three-dimensional puzzle as defined in claim 25, said end part comprising at least one squared part, a cylindrical extension and a separate lid; said extension and squared part having at least one spring disposed therein.

27. A three-dimensional puzzle as defined in claim 25, the outer faces of said blocks forming the overall shape of a polygon.

28. A three-dimensional puzzle as defined in claim 25, the outer faces of said blocks forming the overall shape of a sphere.

29. A three-dimensional puzzle as defined in claim 25, the outer surface of said blocks having an indicia applied thereto.

30. A three-dimensional puzzle as defined in claim 29, said indicia comprising a color.

31. A three dimensional puzzle as defined in claim 25, said geometric shape comprising a cube.

32. A three dimensional puzzle as defined in claim 31, said building blocks comprising elements which are engaged to said fastening means and have substantially flat outer surfaces.

33. A three dimensional puzzle as defined in claim 32, said cube comprising five layers of elements whereby a 5 by 5 size cube is formed.

34. A method of assembling a three dimensional puzzle having the shape of a 5 by 5 cube comprising steps of:

a. forming co-planar arms of a cross about a center piece and attaching headpieces to the ends thereof;
b. fitting middle edge elements between said arms;
c. fitting edge field elements into spaces formed between said middle edge elements and said headpieces whereby a middle layer is formed;
d. placing corner edge elements, corner field elements and edge field elements into a channel formed by said middle layer, whereby an intermediate layer is formed;
e. placing into a channel formed by said intermediate layer, corner elements, middle edge elements and corner edge elements, whereby the external layer of the cube is formed;
f. placing into a space formed within said external layer edge field elements and corner field elements;
g. forming an arm of said cross extending throughout said middle, intermediate and external layers;
h. attaching a headpiece with a cover to said arm; and
i. inverting said cube and cross and repeating steps d through h.

* * * * *